US006119991A

United States Patent [19]

Thorne, III et al.

[11] Patent Number: 6,119,991

[45] Date of Patent: Sep. 19, 2000

[54] RACING WHEEL CLAMP

[75] Inventors: Edwin Thorne, III, Palo Alto; David McVicar, El Dorada, both of Calif.

[73] Assignee: Logitech, Inc., Fremont, Calif.

[21] Appl. No.: 09/260,383

[22] Filed: Mar. 2, 1999

[51] Int. Cl.[7] ..... G09F 7/18

[52] U.S. Cl. ..... 248/229.2; 248/918

[58] Field of Search ..... 248/229.2, 917, 248/918, 229.23, 229.21, 229.22, 229.24, 229.25, 227.2, 228.4, 231.21, 231.31, 231.51, 231.61, 231.71, 226.11, 205.1, 118, 118.1, 118.3, 118.5; 108/97, 152

[56] References Cited

U.S. PATENT DOCUMENTS

| | | | |
|---|---|---|---|
| 2,512,958 | 6/1950 | Meier | 108/97 |
| 3,301,406 | 1/1967 | Scott | 108/97 X |
| 4,032,101 | 6/1977 | Immordino | 248/231.31 |
| 4,846,431 | 7/1989 | Pflieger | 248/228.4 |
| 5,119,742 | 6/1992 | Simmie | 248/214 X |
| 5,701,991 | 12/1997 | Helmetsie | 248/228.4 X |
| 5,722,624 | 3/1998 | Watt et al. | 248/205.1 |
| 5,927,663 | 7/1999 | Tseng | 248/918 X |

*Primary Examiner*—Ramon O. Ramirez
*Attorney, Agent, or Firm*—Townsend and Townsend and Crew LLP

[57] ABSTRACT

A computer game controller is provided that can be attached to a desktop having a lip of greater thickness located near an outer portion of the desktop and an underside surface located on an inner portion of the desktop. The lip has a substantially greater thickness than the remainder of the desktop and this poses a substantial challenge to the proper gripping and mechanical advantage required by a clamp device. In one embodiment of the present device, the present computer controller includes a housing with a substantially flat, planar bottom surface that will act as one side of the clamp. The controller has a clamp arm coupled to the housing so that a distal contact surface of the arm is substantially opposed to the bottom surface of the housing to operably compress a portion of a desktop therebetween. The arm is designed to have a length sufficient to allow the distal contact surface of the arm to reach the underside surface of the desktop, thus allowing the arm to grip a portion of the desktop located beyond the lip. Gripping an inner portion of the desktop allows the arm to increase its mechanical advantage in securing the object or computer peripheral to the desktop.

22 Claims, 6 Drawing Sheets

RACING WHEEL CLAMP

BACKGROUND OF THE INVENTION

The present invention relates generally to devices and methods for releasably securing an object to a substantially planar surface. More particularly, the present invention is useful for clamping a computer game controller such as a joystick or steering wheel to a desktop surface.

In computer gaming for personal computer (PC) systems, it is common practice to provide specialized or dedicated user interface controllers such as joysticks or steering wheels to supplement and improve the computer gaming experience provided by keyboard control alone. In some embodiments, these additional computer game controllers are free floating, hand-held devices, which the user holds to control game play on a computer screen. In other embodiments, it is desirable to secure the computer game controller to a stable surface such as desktop or table surface. Computer game peripherals such as a steering wheel controller are particularly suited for clamping to such a fixed surface since both hands of the user are typically required to grip the steering wheel and/or operate associated controllers such as gear shifters and the like.

Experience has shown that conventional devices used to secure these game controllers to a desktop or table surface are often unable to provide adequate anchoring force to withstand the rigors of vigorous user interaction. Furthermore, some of these conventional clamping devices are unable to be secured to tables or desks having a substantial lip located along an outer edge of the desktop. For example, the lip on the desktop may be of such size that a clamp when fully extended or opened will still be unable to engage the lip or desktop. More often, as shown in FIG. 1, the controller may only be able to clamp to the limited surface area provided by the lip along on the outer edge of the desk, which provides insufficient mechanical advantage to adequately secure the game controller to the desktop during vigorous game play. Additionally, it is advantageous in certain situations to have the contact surface of the clamp engaging a portion of the desk which is not readily visible so that any damage that may occur to the desk by the clamping will not occur at a location that will cosmetically blemish the desktop.

Accordingly, it is thus desirable to provide improved clamping devices which can more adequately secure the games controller to a desktop. It would also be desirable to provide an improved design so that the controller may be adapted to fit a wider variety and selection of desktops and table surfaces.

SUMMARY OF THE INVENTION

The present invention provides a computer controller that includes a housing with a substantially flat, planar bottom surface that will act as one side of the clamp. The computer controller has an arm coupled to the housing so that a distal contact surface of the arm is substantially opposed to the bottom surface of the housing to operably compress a portion of a desktop therebetween. The arm is designed to have a length sufficient to allow the distal contact surface of the arm to reach the underside surface of the desktop, thus allowing the arm to grip a portion of the desktop located beyond the lip. Gripping an inner portion of the desktop allows the arm to increase its mechanical advantage in securing the object or computer peripheral to the desktop.

Generally, a computer game controller is provided that can be attached to a desktop having a lip of greater thickness located near an outer portion of the desktop and an underside surface located on an inner portion of the desktop. The lip has a substantially greater thickness than the remainder of the desktop and this poses a substantial challenge to the proper gripping and mechanical advantage required by a clamp device.

In preferred embodiments, the arm of the controller is substantially curved so as to allow the arm to reach around objects on the underside of the table such as the lip. The arm is also typically hinged to the housing to facilitate alignment and positioning of the arm of the clamp to the desktop. A tigthening device which reciprocates vertically to move the arm closer to and away from the underside of the desktop, is typically located near a proximal end of the arm. Typically, but not necessarily, the arm can rotate through a range of motion of about 85 to 150 degrees.

In another aspect of the present invention, a method is provided for attaching a game controller to a desktop with a lip located on an outer portion of the desktop. The method includes positioning a game controller housing on the desktop and then positioning clamps coupled to the housing to contact an underside surface located on an inner portion of the desktop beyond the outer lip. Typically, with the clamps properly positioned, they are tigthened to provide compressive force about the desktop. The clamp typically has a distal contact surface which alone with the bottom surface of the housing provides the majority of the compressive force about the desktop. Typically, but not necessarily, the clamp uses an arm having a length of at least 4 inches.

The present invention provides improved devices and methods for securing a device such as a computer game peripheral or controller to a support surface such as a table or desktop. The present invention advantageously allows the object or controller to be secured to a desktop of varying shapes and configurations. In particular, the present invention provides devices and methods for clamping the game controller or computer peripheral to a desktop having a lip located near an outer portion of the desktop which may interfere with the ability of conventional clamping systems to secure the computer peripheral to the desktop. In some embodiments, the present invention is adapted to grip a table surface having a lip of substantially greater thickness than the remainder of the desktop.

A further understanding of the nature and advantages of the invention will become apparent by reference to the remaining portions of the specification and drawings.

DESCRIPTION OF THE SPECIFIC EMBODIMENTS

The present invention is directed towards devices and methods for attaching an object such as a computer game peripheral to a support surface such as a desktop. In use for computer gaming, the present invention must be able to withstand rigorous game play by the user while maintaining the computer game controller on the surface of the support member. This is required since in certain applications where the present clamping apparatus is used, both hands of the user are used to provide feedback through the computer game controller to control action on the computer screen, and are thus unavailable for providing an anchor or base for the game controller. Preferably, the arms of the clamp are designed for ease of manufacturing and ease of assembly so as to increase production throughput of devices using clamps according to the present invention. In addition to providing improved mechanical advantage while anchoring the game controller to the desktop, the clamps according to the present invention also provide added versatility in the different types and configurations of desktops for which the present invention may be used.

Figure 1:
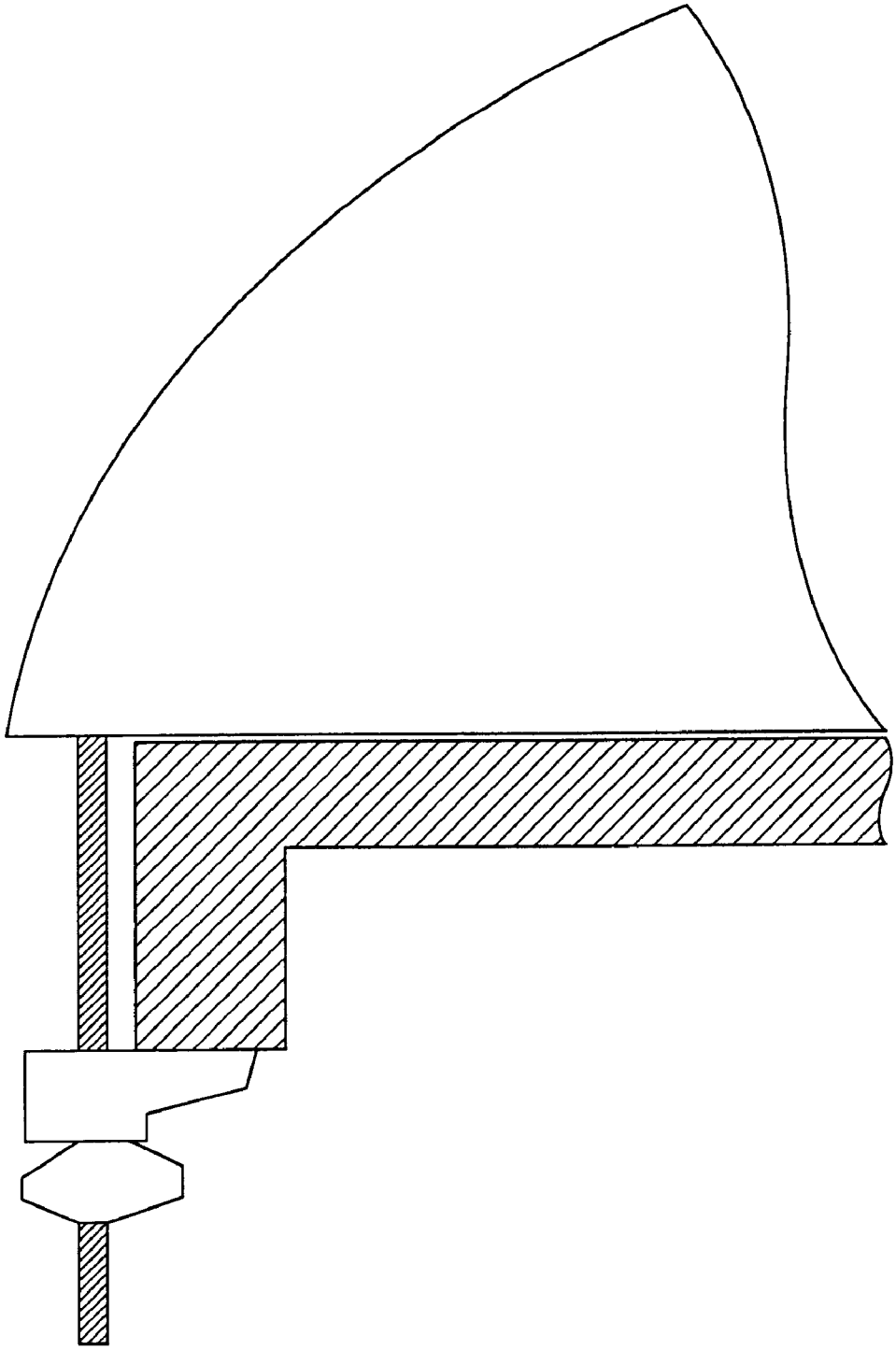
FIG. 1 PRIOR ART
FIG. 1 shows a cross-sectional view of a prior art clamp assembly.
Figure 2:
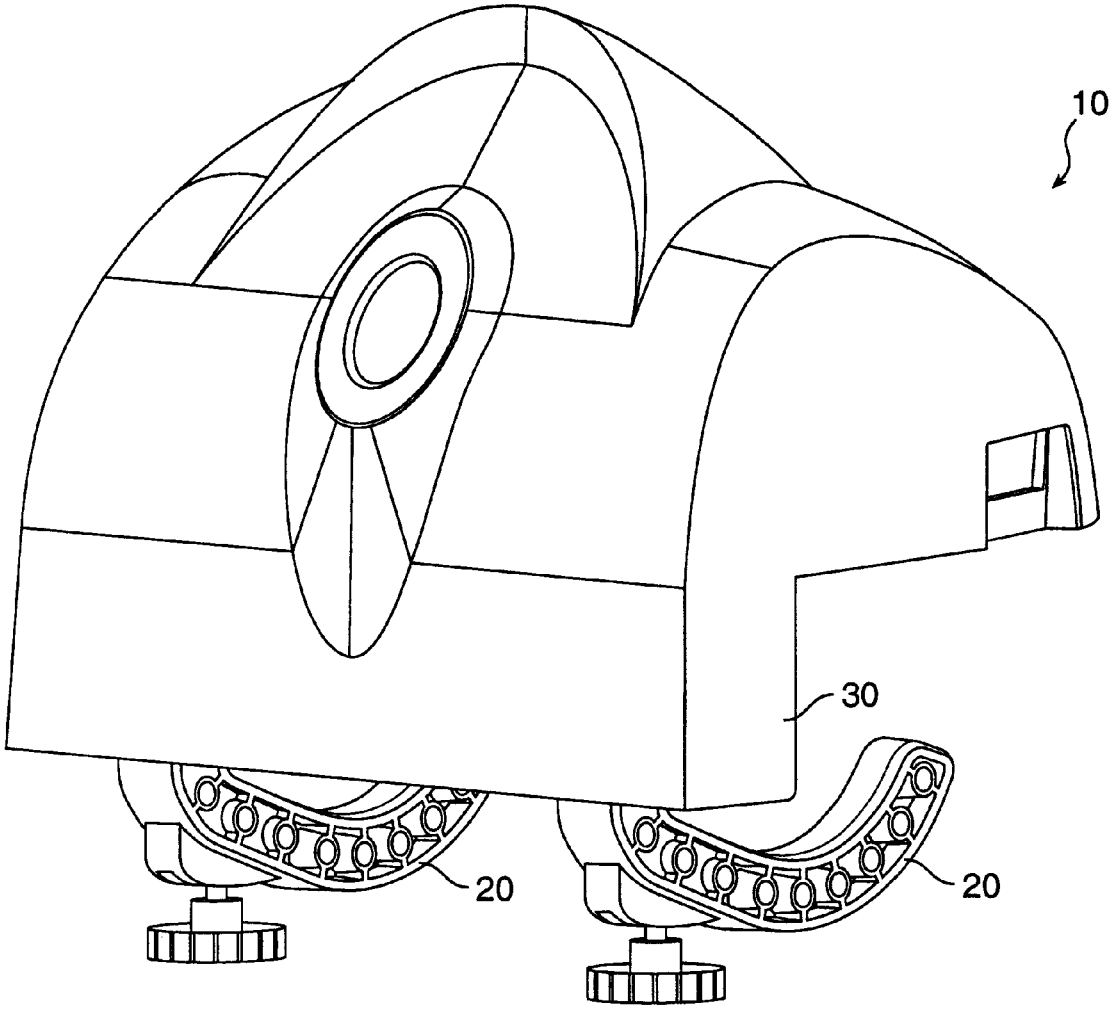
FIG. 2 is a perspective view of one embodiment of a computer game controller having a clamp assembly according to the present invention.

Referring to FIGS. 2 through 6, a clamping device according to the present invention will now be described. In one embodiment as shown in FIG. 2, a computer game controller housing 10 for attachment to a desktop D includes two substantially curved clamp arms 20 mounted on a lip portion 30 of the housing 10. Although the housing 10 presently shown in FIG. 2 is adapted for use with a steering wheel controller, it should be understood that the housing may be designed for a variety of other uses such as computer peripherals having dual joysticks or for non-computer gaming uses. Typically, the housing 10 is made of a plastic or polymer material such as ABS which provides sufficient structural strength and cosmetic appearance while promoting ease of manufacture and reduced cost per part. Some embodiments of the computer game controller housing 10 may be designed without the lip portion 30. The lip portion 30, however, advantageously provides an additional surface on which the game controller may be supported.

Figure 3:
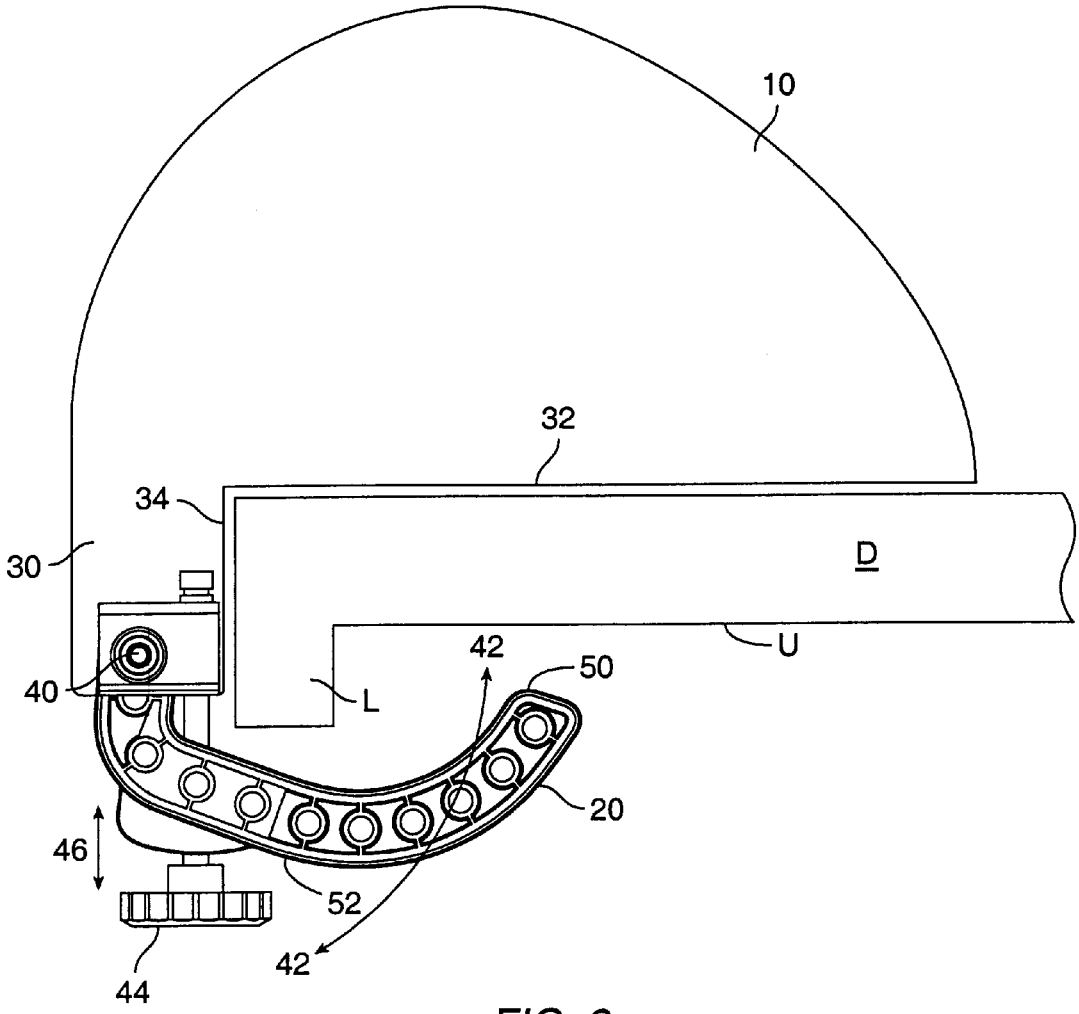
FIG. 3 illustrates a side cross-sectional view of the controller in FIG. 2 attached to a desktop.

Referring now to FIG. 3, a cross-sectional view of the housing 10 and a side-view of the clamp arm 20 will now be described. As shown in FIG. 3, a bottom surface 32 of the housing 10 rests on an upper surface of the desktop D. Preferably, the housing 10 is positioned so that the bottom surface 32 and vertical surface 34 of the lip portion 30 are in contact with the desktop D. As shown in the figure, the desktop D may be of an irregular shape having a lip L located near an outer edge or outer portion of the desktop. The lip L of the desktop D has a thickness that is typically substantially greater than the remainder portion of the desktop D. The desktop D has an underside surface U which extends along inner portions of the desktop away from the lip L. As shown in FIG. 3, the clamp arm 20 is connected by a hinge 40 to the housing 10, thus allowing for rotational motion of the arm as indicated by arrows 42. This places a pivot point of the clamp arm 20 near one end of the arm. Vertical translation of a locking or tigthening screw 44, as indicated by arrow 46, can position the clamp arm 20 to operably compress the desktop D between the bottom surface 32 and the clamp arm 20. As can be seen in the figures, the clamp arm 20 is of sufficient length to reach beyond the lip L of the desktop D and contact the underside surface U. Preferably, the clamp arm 20 contacts the underside surface U with a contact surface 50 located near a distal end of the clamp arm. Positioning the contact point 50 in this manner improves the mechanical advantage provided by the clamp arm 20. Thus, the housing 10 attached as shown can resist higher levels of torsional forces applied by the user which may cause conventional systems to loose grip and detach from the desktop D. Typically, the clamp arm 20 can exert about 10–14 pounds of holding force, preferably about 12 pounds, to secure the housing 10 to the desktop D. Firmly securing the housing to the desktop D further enhances game play by allowing the user to focus on the action displayed by the computer screen without worrying about whether the computer game controller will shift during play.

As shown in FIG. 3, the clamp arm preferably has sufficient curvature to extend around the lip L of the desktop D to contact the underside surface U. The arm also typically has a horizontal length at least half that of the housing 10. In some embodiments, the clamp arm 20 may have length of at least 40% of the horizontal length of the housing 10, preferably about 50%. Typically, the clamp arm 20 has a horizontal length between about 4 and 6 inches. Typically, the vertical distance between the contact surface 50 and a bottom surface 52 on the clamp arm 20 is between about 1.5 and 3.0 inches. This allows the clamp arm 20 to reach around objects such as lips L of about 3 inches in height. Preferably, as previously mentioned, the surface 34 is also placed against a vertical surface of the desktop D to provide further stability to the mounting of the housing 10. As shown in FIG. 3, the clamp arm is typically able to reach around the lip L without contacting the lip. Although it is preferred that the contact surface 50 at the distal end of a clamp arm 20 contacts the underside U without portions of the clamp arm 20 contacting the lip L (so that the lip L does not interfere with compression of the desktop D between the bottom surface 32 and the clamp arm 20), it should be understood that the clamp arm 20 may be designed to contact both the lip L and the underside surface U as desired. Additionally, the contact surface 50 of the arm 20 has a rounded portion which provides "cam-action" to provide a further improved grip to the desktop D. As the arm 20 is tigthened against the desktop D, the arm begins to flex and straigthen, causing the rounded portion of contact surface 50 to slide and press more firmly against the underside U of the desktop.

Figure 4:
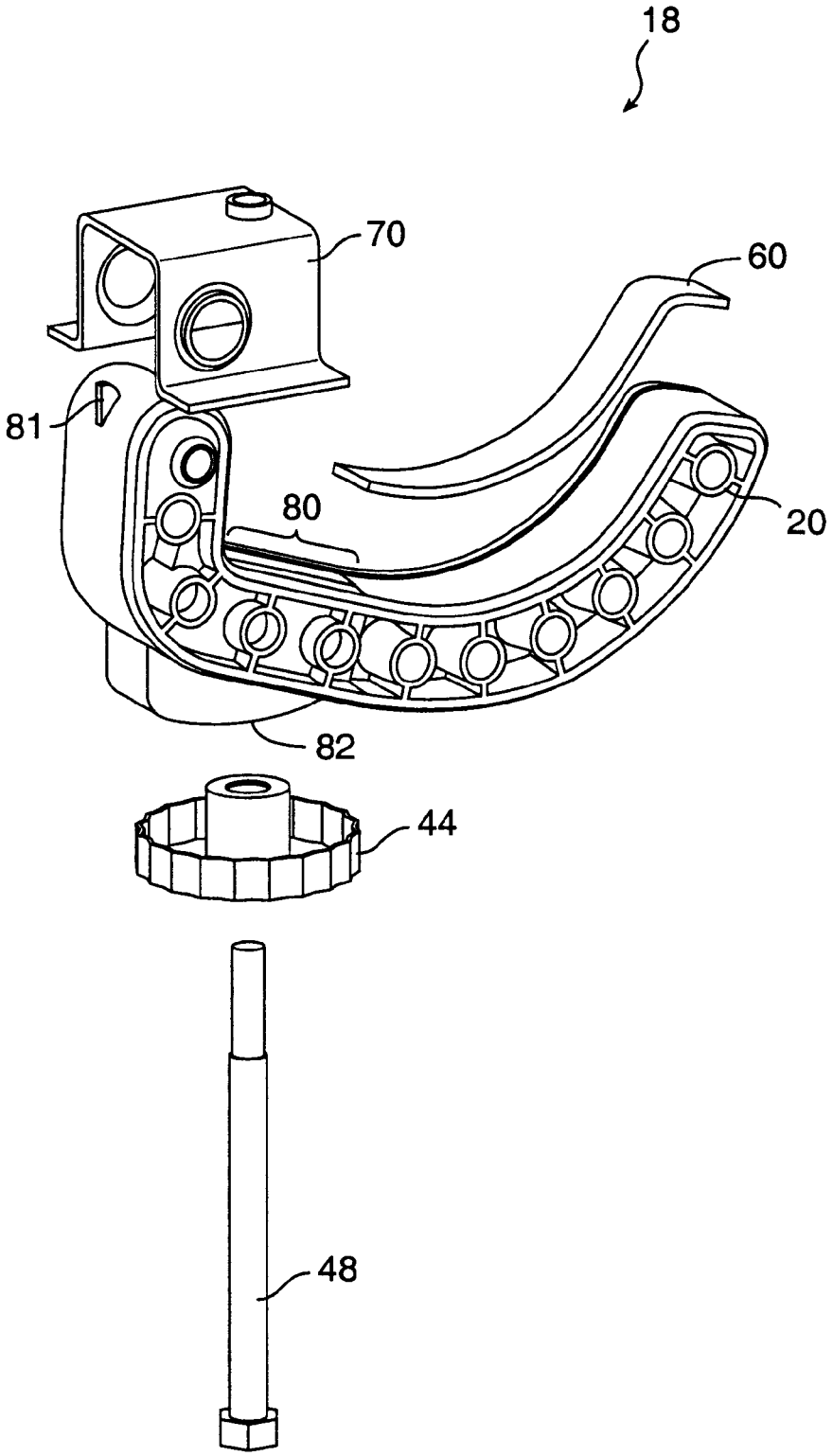
FIG. 4 shows an exploded view of a clamp assembly according to the present invention.

Referring now to FIG. 4, an exploded view of the clamp assembly 18 will now be described. One embodiment of a clamp assembly 18 includes a clamp arm 20 having a layer of contact material 60, a hinge bracket 70, and rotatable member 44 and screw 48. An opening 80 in the clamp arm 20 allows the arm to swing through a variety of angles about the screw 48. The contact material 60 is preferably a gripping material such as a polymer, rubber, neoprene, or the like. The material 60 is typically compressive and frictional for optimizing the gripping contact with the desktop D. The material 60 may have a variety of lengths such as between about 1 and 4 inches and may extend along arm 20 as shown. The opening 80 is typically sized between about 1 and 1.5 inches, allowing the arm 20 to have a range of motion of approximately 50 degrees, more preferably 65 degrees. A slightly rounded contact surface 82 interacts with the rotatable member 44 in positioning the clamp arm 20. Surface 82 has a slot (visible in FIG. 2) which, with its rounded surface, allows the knob of tigthening screw 44 to tigthen against a surface which is generally horizontal at different angles of arm 20. Abutment 81 is a stop for limiting rotation of arm 20. This abutment 81 contacts the bracket 70 or the housing portion 30 to stop rotation of the arm 20.

Figure 5:
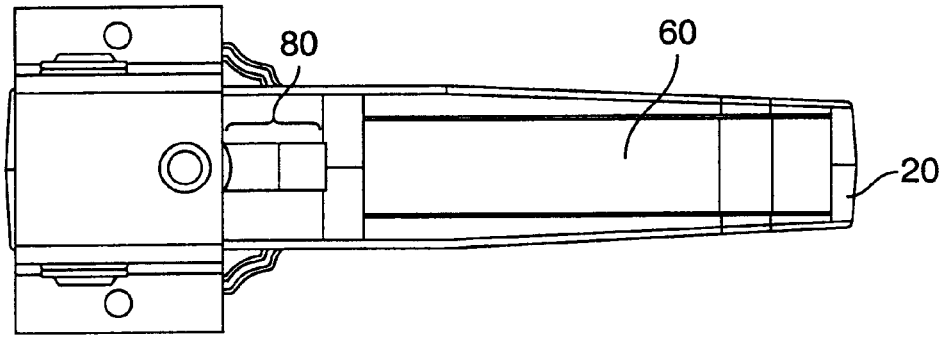
FIG. 5 is a top-down view of the clamp assembly of FIG. 4.
Figure 6:
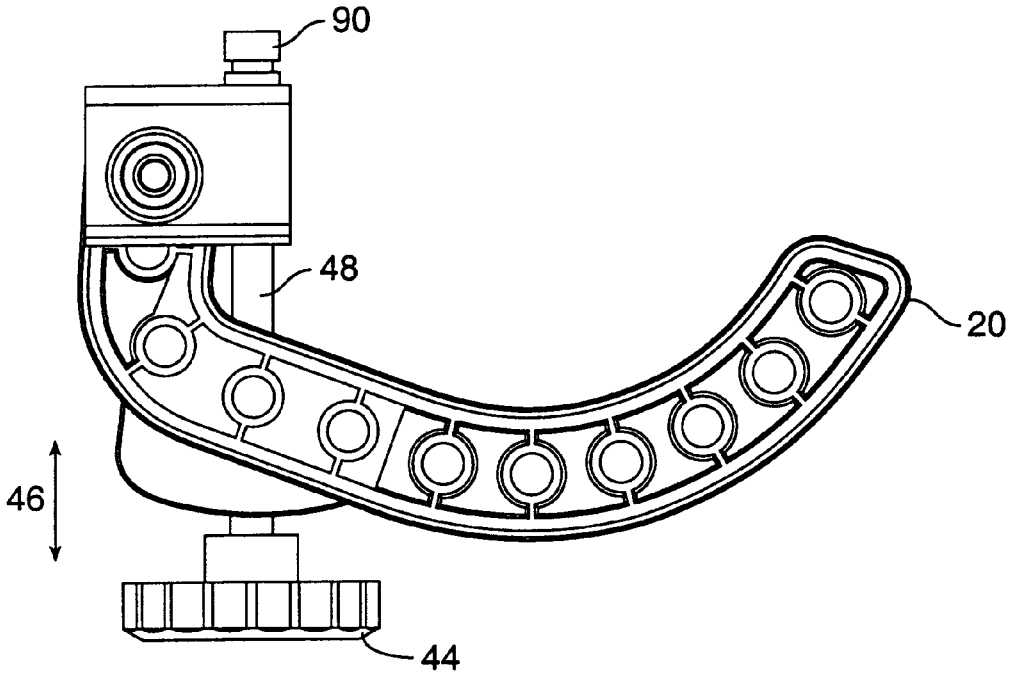
FIG. 6 is shows a side-view of the clamp assembly of FIG. 4.

Referring now to FIGS. 5 and 6, a fully assembled clamp assembly 18 will now be described. FIG. 5 provides an upper view of the clamp assembly 18. The clamp arm 20, as seen in FIG. 6, typically has a plurality of holes or openings which reduces the weight of the arm and further improves the injection molding or manufacture of the part. Movement of the rotatable member 44 controls the positioning of the clamp arm 20. As previously mentioned, the rotatable member 44 moves as indicated by arrows 46 in a vertical direction to move the clamp arm 20 through a variety of angular positions. The member 44 typically engages the screw on a substantially flat or sometimes rounded portion of the arm 20. The screw 48 passing through the arm 20 typically has a locknut 90 located on its distal end so that the screw 48 cannot be completely removed from the clamp assembly 18. This reduces the likelihood that a user may accidentally disassemble the clamp assembly 18 and shear away threads on the screw 48 when reassembling clamp. Destruction of the clamp assembly 18 substantially eliminates the functionality of a steering wheel controller since the controller is difficult to operate when it is unanchored, resulting in returned products and reduced profitability.

Figure 7:
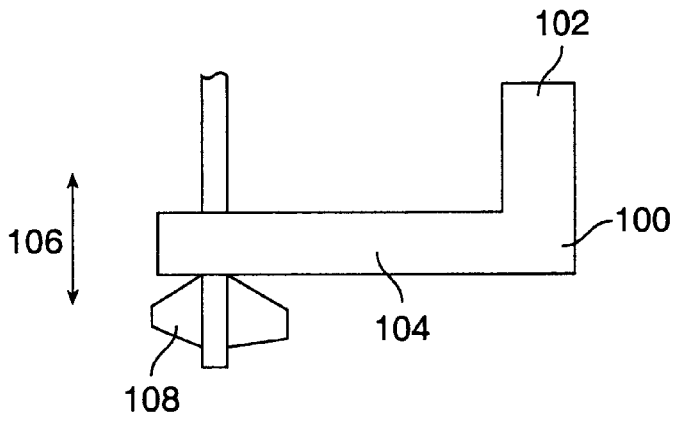
FIG. 7 illustrates an alternative embodiment of a clamp assembly according to the present invention.

FIG. 7 shows an alternative embodiment of the clamp arm. As shown in FIG. 7, clamp arm 100 has a substantially L-shaped configuration. The arm may have a variety of other configurations such as U-shaped or C-shaped, so long as there is a vertical differential between the contact surface 102 and an undersurface 104 of the arm 100. This allows the arm 100 to reach around obstacles while contacting the underside surface U of the desktop. As shown in FIG. 7, the arm is traversed vertically as indicated by arrow 106 through the movement of member 108. The arm 100 may be hinged or attached to the housing in the manner as shown in FIG. 7.

Figure 8:
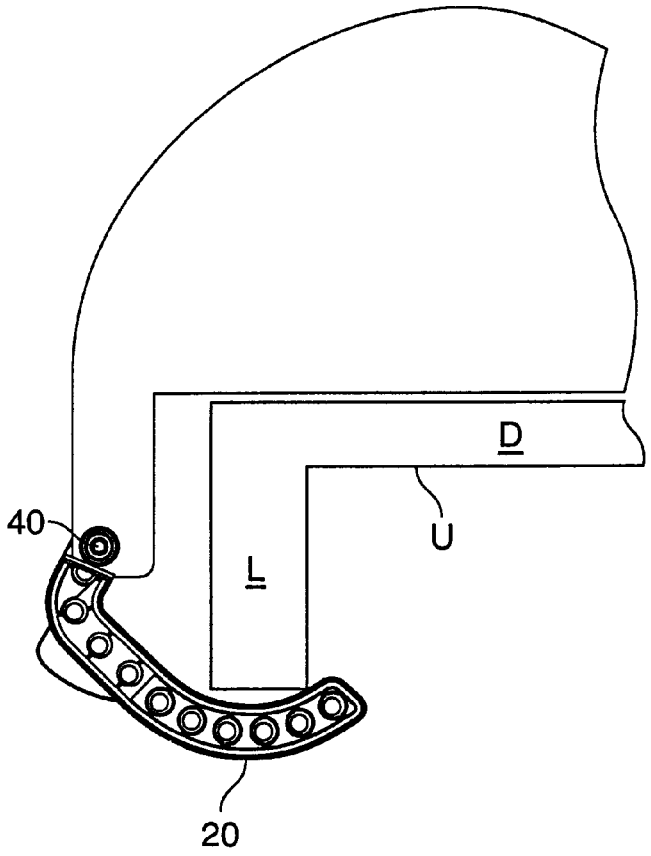
FIG. 8 shows an alternative method of clamping a game controller to a desktop.

Referring now to FIG. 8, it is preferred that the clamp arm 20 be attached to the housing 10 using a connection such as hinge 40 which allows for rotatable motion of the arm. As shown in FIG. 8, in some scenarios where the lip L is of such thickness that the clamp arm 20 cannot reach around to contact the underside surface U of the desktop D, having a rotatable connection allows the arm 20 to be positioned to grip the underside of the lip L. Although this is not the optimal configuration of the arm 20, an arm according to the present invention provides sufficient versatility to allow the housing 10 to be secured to the desktop D. This thus provides functionality to the game controller in situations where conventional clamp systems may be unable to adapt to the increased thickness of the lip L. Hence the present invention may be adapted to fit a greater variety of desks and desk configurations.

While all the above is a complete description of the preferred embodiments of the inventions, various alternatives, modifications, and equivalents may be used. For example, other embodiments of the present invention may have fewer or additional numbers clamp arms mounted to housing. The clamp arm may also be attached to the housing using other methods than a hinge, such as a pistol grip type clamping device that is slidable along a vertical railing. Although the foregoing invention has been described in detail for purposes of clarity of understanding, it will be obvious that certain modifications may be practiced within the scope of the appended claims.

What is claimed is:

1. A computer peripheral to be placed on top of an upper surface of a desktop and to be attached to the desktop which has a lower surface and an edge between the upper surface and the lower surface, the computer peripheral comprising:

a computer peripheral housing;

a clamp including a clamp arm having a proximal end, a distal end, and a contact surface disposed between the proximal end and the distal end, the proximal end of the clamp arm being pivotally attached with the computer peripheral housing at a pivot location on the computer peripheral housing to pivot between a clamped position and an unclamped position, the contact surface being configured to be spaced from the lower surface of the desktop in the unclamped position and to contact the lower surface of the desktop in the clamped position; and an adjustment member coupled between the clamp arm and the computer peripheral housing for adjusting a pivot position of the clamp arm relative to the pivot location with respect to the computer peripheral housing, the adjustment member comprising a tigthening screw having a proximal end portion connected with the clamp arm, the tigthening screw having a distal end portion extending through an opening in the clamp arm and being connected with the computer peripheral housing wherein the opening in the clamp arm is elongated in a direction between the proximal end and the distal end of the clamp arm to allow the tigthening screw to shift in position therein during pivoting of the clamp arm relative to the pivot location on the computer peripheral housing.

2. The computer peripheral of claim 1 wherein the computer peripheral housing includes a hinge bracket and the clamp arm is always connected with the hinge bracket to form a hinge connection at the pivot location on the computer peripheral housing.

3. The computer peripheral of claim 1 wherein the clamp arm has a U-shaped configuration or an L-shaped configuration between the proximal end and the distal end.

4. The computer peripheral of claim 1 wherein the clamp arm is configured to be pivotally attached with the computer peripheral housing at a pivot location on the computer peripheral housing adjacent the edge of the desktop.

5. The computer peripheral of claim 1 wherein the contact surface of the clamp arm is located at or near the distal end.

6. The computer peripheral of claim 1 wherein the distal end of the clamp arm includes a rounded distal tip adapted to flex and straigthen the arm when the tigthening screw is tigthened.

7. The computer peripheral of claim 1 wherein the clamp arm is configured to exert in the clamped position at least about 12 pounds of holding force against the desktop.

8. A computer peripheral to be placed on an upper surface of a desktop and to be attached to the desktop which includes a lip having a greater thickness than the remainder of the desktop, the lip being located on an outer portion of the desktop and forming an outer edge, the desktop including an underside surface located on an inner portion of the desktop, the computer peripheral comprising:

a computer peripheral housing having a bottom surface configured to be disposed on the upper surface of the desktop;

an arm having a proximal end, a distal end, and an intermediate surface being disposed between the proximal end and the distal end and being bent around to accommodate the lip of the desktop, the proximal end of the clamp arm being pivotally attached with the computer peripheral housing at a pivot location to pivot between a clamped position and an unclamped position, the arm including a distal contact surface at or near the distal end which is substantially opposed to the bottom surface of the housing for operably compressing a portion of the desktop therebetween in the clamped position, the arm having a length between the proximal end and the distal end selected to allow the distal contact surface to contact the underside surface of the desktop located beyond the lip in the clamped position, the distal contact surface being configured to be spaced from the underside surface of the desktop in the unclamped position; and an adjustment member coupled between the clamp arm and the computer peripheral housing for adjusting a pivot position of the clamp arm relative to the pivot location with respect to the computer peripheral housing the adjustment member comprising a tigthening screw having a proximal end portion connected with the clamp arm, the tigthening screw having a distal end portion extending through an opening in the clamp arm and being connected with the computer peripheral housing wherein the opening in the clamp arm is elongated in a direction between the proximal end and the distal end of the clamp arm to allow the tigthening screw to shift in position therein during pivoting of the clamp arm relative to the pivot location on the computer peripheral housing.

9. The computer peripheral of claim 8 wherein the arm has a length and a shape selected to allow the distal contact surface to reach around the lip of the desktop to contact the underside surface at a distance between about 3 and 5 inches from the outer edge of the desktop.

10. The computer peripheral of claim 8 wherein the computer peripheral housing includes a hinge bracket with spaced openings, and wherein the arm includes a rod at the proximal end extending between the spaced openings of the hinge bracket to form a hinge connection at the pivot location.

11. The computer peripheral of claim 8 wherein the arm is configured to prevent contact between the intermediate surface of the arm and the lip of the desktop in the clamped position.

12. The computer peripheral of claim 8 wherein the bottom surface of the computer peripheral housing includes a bottom surface lip which is configured to allow the housing to contact the upper surface and the outer edge of the desktop.

13. A computer peripheral to be placed on top of an upper surface of a desktop and to be attached to the desktop which has a lower surface and an edge between the upper surface and the lower surface, the computer peripheral comprising:

a computer peripheral housing;

a clamp including a clamp arm having a proximal end, a distal end, and a contact surface disposed between the proximal end and the distal end, the proximal end of the clamp arm being pivotally attached with the computer peripheral housing at a pivot location on the computer peripheral housing to pivot between a clamped position and an unclamped position, the contact surface being configured to be spaced from the lower surface of the desktop in the unclamped position and to contact the lower surface of the desktop in the clamped position; and an adjustment member coupled between the clamp arm and the computer peripheral housing for adjusting a pivot position of the clamp arm relative to the pivot location with respect to the computer peripheral housing, the adjustment member comprising a tigthening screw having a proximal end portion connected with the clamp arm, the tigthening screw having a distal end portion extending through an opening in the clamp arm and being connected with the computer peripheral housing, wherein the distal end of the clamp arm includes a rounded distal tip adapted to flex and straigthen the arm when the tigthening screw is tigthened.

14. The computer peripheral of claim 13 wherein the computer peripheral housing includes a hinge bracket and the clamp arm is always connected with the hinge bracket to form a hinge connection at the pivot location on the computer peripheral housing.

15. The computer peripheral of claim 13 wherein the clamp arm has a U-shaped configuration or an L-shaped configuration between the proximal end and the distal end.

16. The computer peripheral of claim 13 wherein the clamp arm is configured to be pivotally attached with the computer peripheral housing at a pivot location on the computer peripheral housing adjacent the edge of the desktop.

17. The computer peripheral of claim 13 wherein the contact surface of the clamp arm is located at or near the distal end.

18. A computer peripheral to be placed on an upper surface of a desktop and to be attached to the desktop which includes a lip having a greater thickness than the remainder of the desktop, the lip being located on an outer portion of the desktop and forming an outer edge, the desktop including an underside surface located on an inner portion of the desktop, the computer peripheral comprising:

a computer peripheral housing having a bottom surface configured to be disposed on the upper surface of the desktop;

an arm having a proximal end, a distal end, and an intermediate surface being disposed between the proximal end and the distal end and being bent around to accommodate the lip of the desktop, the proximal end of the clamp arm being pivotally attached with the computer peripheral housing at a pivot location to pivot between a clamped position and an unclamped position, the arm including a distal contact surface at or near the distal end which is substantially opposed to the bottom surface of the housing for operably compressing a portion of the desktop therebetween in the clamped position, the arm having a length between the proximal end and the distal end selected to allow the distal contact surface to contact the underside surface of the desktop located beyond the lip in the clamped position, the distal contact surface being configured to be spaced from the underside surface of the desktop in the unclamped position; and an adjustment member coupled between the clamp arm and the computer peripheral housing for adjusting a pivot position of the clamp arm relative to the pivot location with respect to the computer peripheral housing, the adjustment member comprising a tigthening screw having a proximal end portion connected with the clamp arm, the tigthening screw having a distal end portion extending through an opening in the clamp arm and being connected with the computer peripheral housing, wherein the distal end of the clamp arm includes a rounded distal tip adapted to flex and straigthen the arm when the tigthening screw is tigthened.

19. The computer peripheral of claim 18 wherein the arm has a length and a shape selected to allow the distal contact surface to reach around the lip of the desktop to contact the underside surface at a distance between about 3 and 5 inches from the outer edge of the desktop.

20. The computer peripheral of claim 18 wherein the computer peripheral housing includes a hinge bracket with spaced openings, and wherein the arm includes a rod at the proximal end extending between the spaced openings of the hinge bracket to form a hinge connection at the pivot location.

21. The computer peripheral of claim 18 wherein the arm is configured to prevent contact between the intermediate surface of the arm and the lip of the desktop in the clamped position.

22. The computer peripheral of claim 18 wherein the bottom surface of the computer peripheral housing includes a bottom surface lip which is configured to allow the housing to contact the upper surface and the outer edge of the desktop.

* * * * *